United States Patent [19]

Gossalter

[11] 4,328,862

[45] May 11, 1982

[54] TUBE BUNDLE HEAT EXCHANGER

[75] Inventor: Rene Gossalter, St. Gallen, Switzerland

[73] Assignee: Swisscal Holding S.A., Panama

[21] Appl. No.: 11,578

[22] Filed: Feb. 12, 1979

[30] Foreign Application Priority Data

Feb. 13, 1978 [CH] Switzerland ..... 1538

[51] Int. Cl.[3] ..... F28F 9/04

[52] U.S. Cl. ..... 165/158; 165/173; 165/180; 285/363

[58] Field of Search ..... 165/70, 80–83, 165/173, 158, 143, 145

[56] References Cited

U.S. PATENT DOCUMENTS 2,196,683 4/1940 Pickstone ..... 165/173
2,825,463 3/1958 Thomas ..... 165/158 X
3,301,321 1/1967 Poore ..... 165/82
4,156,457 5/1979 Murray ..... 165/158

FOREIGN PATENT DOCUMENTS 292913 10/1957 Fed. Rep. of Germany ..... 165/173

*Primary Examiner*—Samuel Scott
*Assistant Examiner*—Theophil W. Streule, Jr.
*Attorney, Agent, or Firm*—Edwin E. Greigg

[57] ABSTRACT

A tube bundle heat exchanger including elastic sealing means wherein the elastic medium is confined within separate chambers and compressed in all directions against the inner wall surface of the chambers and heat exchanger tubes within the chamber. Pressure plates that exert pressure on the elastic medium are provided with projections which provide a spacing between the pressure plates. This spacing may be used for inspection for leaks and also permits flow of fluid to the outside if there is a leak.

15 Claims, 2 Drawing Figures

TUBE BUNDLE HEAT EXCHANGER

The invention relates to a tube bundle heat exchanger in which the heat exchanger tubes are sealed by means of elastic sealing tube plates placed under pressure, whereby relaible and constant sealing from outside is made possible.

In tube bundle heat exchangers in accordance with the invention a possible transfer of portions of a medium into the other medium with inappropriate treatment of the sealing means is prevented.

In tube bundle heat exchangers having elastic sealing plates, there has up to now been arranged between the medium that flows around the tubes in the outer space of the tube bundle heat exchanger and the medium that flows within the tubes a sealing arrangement consisting of an elastic sealing tube plate and two rigid tube plates arranged on either side.

By pressing axially upon the two rigid tube plates the elastic sealing tube plate is put under pressure and there results a reliable sealing along the outer periphery of the exchanger tube.

With inappropriate treatment or insufficient pressure of the rigid plates against the elastic plate there exists, however, the possibility, that parts of one medium could pass over into the other medium, without this process being noticed from outside and controlled.

Heat exchangers in accordance with the invention, on the contrary, include for each medium that flows in the tube bundle heat exchanger, a sealing means that seals each medium directly against the open space outside the tube bundle heat exchanger and consists of an elastic sealing tube plate and two rigid tube plates arranged on either side.

To the rigid tube plates between the sealing arrangements there are fixed in accordance with the invention, distance projections or other unevennesses, in order to maintain between the sealing means a distance so great that the mode of operation of the sealing against each medium can be monitored from outside the tube bundle heat exchanger.

The distance projections in accordance with the invention may transmit the force necessary for pressing the elastic sealing plate.

Should a sealing means fail owing to inappropriate treatment, then in the tube bundle heat exchanger in accordance with the invention the respective medium can only flow to the outside, and no longer pass over into the other medium.

In tube bundle heat exchangers in accordance with the invention rigid, readily replaceable tube plates are supported by abutments provided in the housing, that are displaceable axially away from the abutments against the elastic sealing plate.

In the tube bundle heat exchanger in accordance with the invention the number and arrangement of the heat exchanger tubes can be altered without altering the housing by replacing the inserted tube plates.

The operating pressure of the media flowing in the tube bundle heat exchanger assists in the pressing of the rigid tube plates against the elastic sealing tube plates, so that the operation of the sealing is automatically matched to the working pressure.

All of the surfaces and parts in contact with the media are readily accessible for inspection and cleaning.

An exemplary embodiment of the invention is illustrated in FIGS. 1 and 2.

Figure 1:
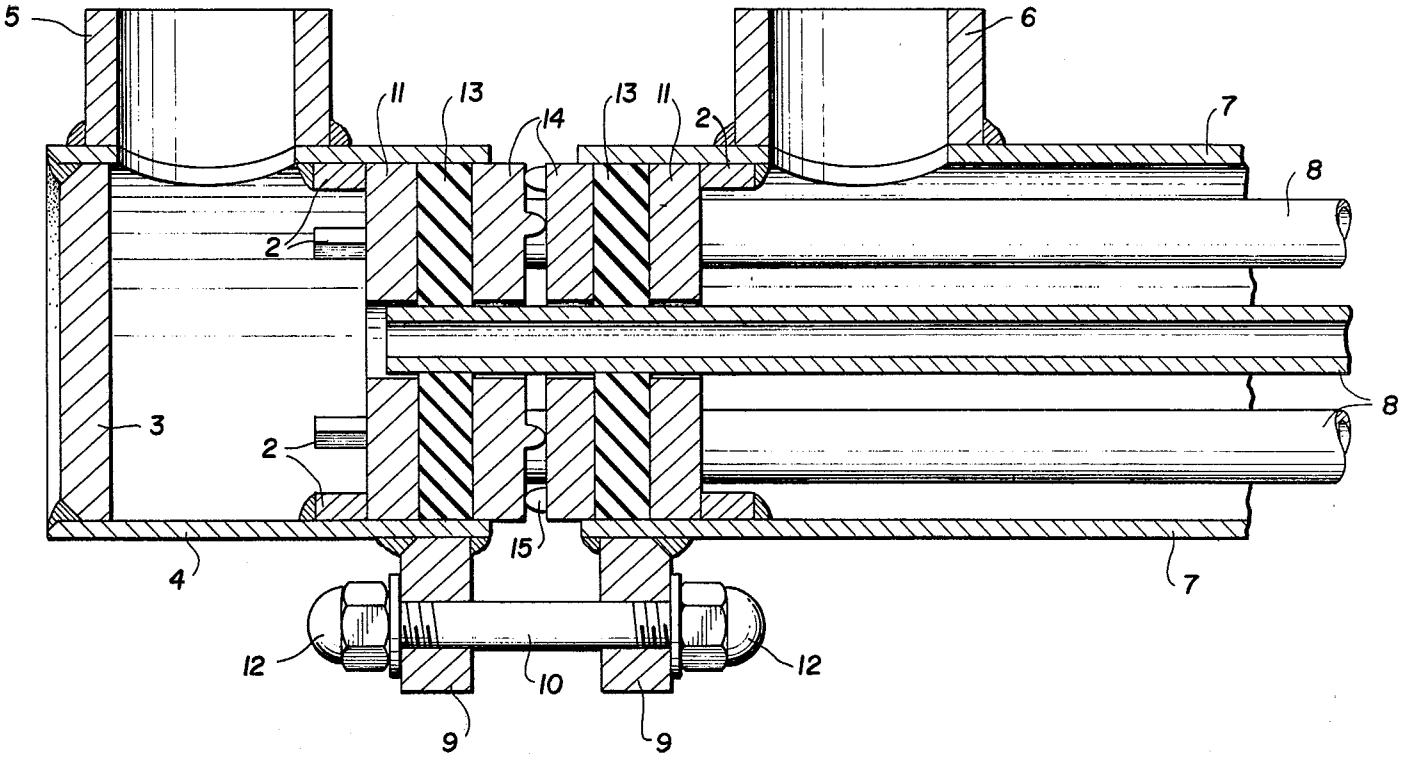
FIG. 1 represents the longitudinal section of an end connection of an exemplary embodiment of a tube bundle heat exchanger in accordance with the invention of welded construction and with equal pressure in the elastic material of the elastic sealing tube plates 13.

The connecting sleeve 6 for the entrance and emergence of the medium, that flows in the outer space of the tube bundle heat exchanger, is welded directly to the jacket tube 7.

The jacket tube 7 contains the abutments 2, that support a rigid tube plate 11.

In addition a plurality of screw brackets 9 are welded to the jacket tube 7.

The extension tube 4 carries the connecting sleeve 5, through which the medium which flows in the tubes, enters or emerges.

The extension tube 4 is closed outwardly by the cover 3 and contains a plurality of abutments 2, to support a rigid tube plate.

In FIG. 1 there lie between the elastic sealing tube plates 13 the two rigid tube plates 14, which are spaced apart by distance projections 15.

The extension tube 4 has a plurality of screw brackets 9.

In FIG. 1 the tension screws 10 with the aid of the nuts 12 draw the extension tube 4 axially against the jacket tube 7, so that the elastic sealing tube plates 13 are compressed by the rigid tube plates 11 and 14. The elastic material of the elastic sealing tube plates 13 is thus pressed against the surfaces of the heat exchanger tubes 8 and the internal surfaces of the extension tube 4 and of the jacket tube 7, so that reliable sealing results. The over-pressure in the medium assists in the pressing.

Figure 2:
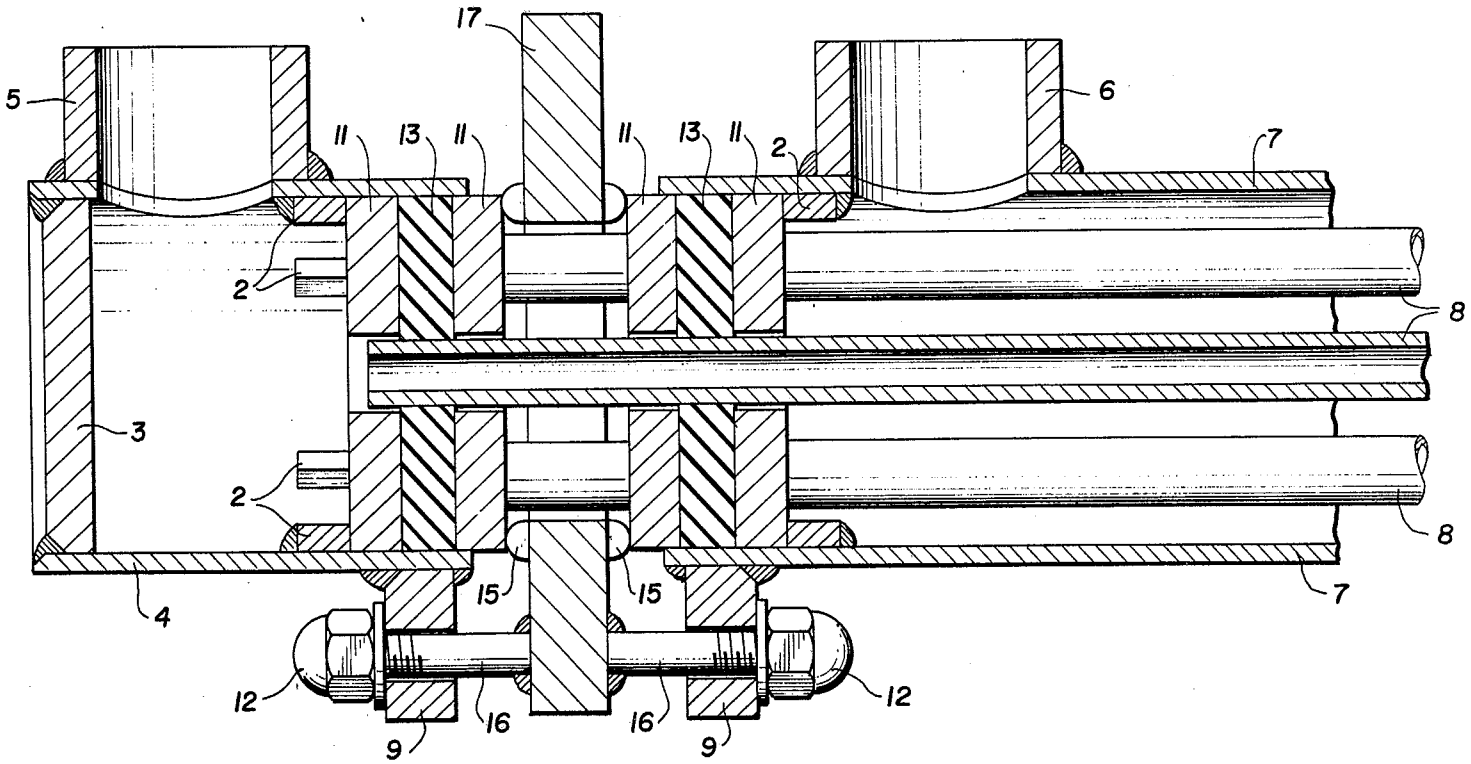
FIG. 2 represents the longitudinal section of a connecting end of an exemplary embodiment of a tube bundle heat exchanger according to the invention, of welded construction, in which the pressure in the elastic material of the elastic sealing tube plates 13 may be of different height for each of the elastic sealing tube plates 13.

If the values of the operating pressures in the tube bundle heat exchanger are very different, then it may be attained, by means of an exemplary embodiment of the invention in accordance with FIG. 2, that the pressures of the elastic materials of the elastic sealing tube plates 13 are of different height and matched to the operating pressure of the individual medium.

Additional pressure upon the elastic sealing tube plates 13 through the operating pressure of a medium flowing in the tube bundle heat exchanger as a result of the axial displaceability of the rigid tube plates affects in the embodiment of FIG. 2 only the elastic sealing tube plate sealing the individual medium from the outside.

In accordance with the embodiment of FIG. 2 each elastic sealing tube plate may consist of a respective elastic material, of which the hardness is matched to the operating pressure of the respective medium.

The screw studs 16 are fastened upon a completely external support 17.

With the help of the nuts 12 the jacket tube 7 and the extension tube 4 are respectively pressed against the support 17.

In the exemplary embodiment in accordance with FIG. 2 the support 17 has the form of a flange ring, on which protuberances 15 are placed, against which the rigid tube plates 11 abut.

Through the space between the flange ring and the rigid tube plates 11 and operation of the seal for each medium can be inspected and supervised from outside.

What we claim is:

1. A tube bundle heat exchanger with sealing means for replaceable heat exchanger tubes comprising:

a jacket tube through which a plurality of fluid carrying tubes pass, a first fluid flow means connected to said jacket tube;

an extension tube in axial alignment with said jacket tube into which fluid is admitted, a second fluid flow means connected to said extension tube;

a first sealing means surrounding each of said fluid carrying tubes passing through said jacket tube and confined by one end of said jacket tube;

a second sealing means surrounding one end of each of said fluid carrying tubes extending into said extension tube and confined by one end of said extension tube adjacent said first sealing means;

each of said first and second sealing means including an elastic sealing medium sandwiched between first and second rigid plates;

said elastic sealing medium and said first and second rigid plates having the same outer diameter as the inner diamter of said jacket tube and said extension tube with said second rigid plates positioned adjacent each other;

abutment means secured within and to said jacket tube and said extension tube for supporting said first rigid plates against axial movement within said jacket tube and said extension tube, and whereby said first and second rigid plates press against said elastic sealing means to force said elastic means into a sealing engagement with said fluid carrying tubes, said jacket tube and said extension tube.

2. A tube bundle heat exchanger as claimed in claim 1, wherein:

each of said second rigid plates include projections on their adjacent surfaces.

3. A tube bundle heat exchanger as claimed in claim 1, wherein:

said first rigid plate of said first sealing means is exposed to any operating pressure in said jacket tube and axially displaceable against said elastic sealing means therein; and said first rigid plate of said second sealing means is exposed to any operating pressure in said extension tube and axially displaceable against said elastic sealing medium therein.

4. A tube bundle heat exchanger as claimed in claim 1 which includes:

means for forcing said second rigid plates into the ends of said jacket tube and said extension tube, respectively, against said elastic mediums of said first and second sealing means thereby causing radial yielding of said elastic medium toward the inner surfaces of said jacket tube and the outer surfaces of said fluid carrying tubes while preventing radial yielding to the outside of said jacket tube or said extension tube.

5. A tube bundle heat exchanger as claimed in claim 2 which includes:

means for forcing said second rigid plates into the ends of said jacket tube and said extension tube, respectively, against said elastic mediums of said first and second sealing means thereby causing radial yielding of said elastic medium toward the inner surfaces of said jacket tube and the outer surfaces of said fluid carrying tubes while preventing radial yielding to the outside of said jacket tube or said extension tube.

6. A tube bundle heat exchanger as claimed in claim 3 which includes:

means for forcing said second rigid plates into the ends of said jacket tube and said extension tube, respectively, against said elastic mediums of said first and second sealing means thereby causing radial yielding of said elastic medium toward the inner surfaces of said jacket tube and the outer surfaces of said fluid carrying tubes while preventing radial yielding to the outside of said jacket tube or said extension tube.

7. A tube bundle heat exchanger as claimed in claim 4, wherein:

said means for forcing said second rigid plates into the ends of said jacket tube and said extension tube, respectively, includes;

screw brackets secured to the outside surface of said jacket tube and said extension tube and screw means positioned outwardly of said jacket tube and said extension tube which cooperate with said screw brackets.

8. A tube bundle heat exchanger as claimed in claim 5, wherein:

said means for forcing said second rigid plates into the ends of said jacket tube and said extension tube, respectively, includes;

screw brackets secured to the outside surface of said jacket tube and said extension tube and screw means positioned outwardly of said jacket tube and said extension tube which cooperate with said screw brackets.

9. A tube bundle heat exchanger as claimed in claimed 6, wherein:

said means for forcing said second rigid plates into the ends of said jacket tube and said extension tube, respectively, includes;

screw brackets secured to the outside surface of said jacket tube and said extension tube and screw means positioned outwardly of said jacket tube and said extension tube which cooperate with said screw brackets.

10. A tube bundle heat exchanger as claimed in claim 7, wherein:

said screw means includes a common support between each of said second rigid plates.

11. A tube bundle heat exchanger as claimed in claim 8, wherein:

said screw means includes a common support between each of said second rigid plates.

12. A tube bundle heat exchanger as claimed in claim 9, wherein:

said screw means includes a common support between each of said second rigid plates.

13. A tube bundle heat exchanger as claimed in claim 10, wherein:

said common support is a flange ring; and said screw means are secured at one end to said flange ring.

14. A tube bundle heat exchanger as claimed in claim 11, wherein:

said common support is a flange ring; and said screw means are secured at one end to said flange ring.

15. A tube bundle heat exchanger as claimed in claim 12, wherein:

said common support is a flange ring; and said screw means are secured at one end to said flange ring.

* * * * *